US007214147B2

(12) United States Patent
Gutierrez

(10) Patent No.: US 7,214,147 B2
(45) Date of Patent: May 8, 2007

(54) BATTING TRAINING APPARATUS

(76) Inventor: Gregory Gutierrez, 404 St. John Dr., Godfrey, IL (US) 62035

( * ) Notice: Subject to any disclaimer, the term of this patent is extended or adjusted under 35 U.S.C. 154(b) by 0 days.

(21) Appl. No.: 10/854,460

(22) Filed: May 26, 2004

(65) Prior Publication Data

US 2005/0266936 A1 Dec. 1, 2005

(51) Int. Cl.
*A63B 69/00* (2006.01)
*A63B 71/00* (2006.01)

(52) U.S. Cl. ..... 473/417; 473/422

(58) Field of Classification Search ..... 473/417–431, 473/393, 396, 138–144, 415, 422; 273/317.2, 273/317.6, 332, 390, 391, 407; 124/7, 53–55
See application file for complete search history.

(56) References Cited

U.S. PATENT DOCUMENTS

| | | | | | |
|---|---|---|---|---|---|
| 363,693 | A | * | 5/1887 | Spaulding | 414/453 |
| 2,814,402 | A | * | 11/1957 | Schaefer | 414/457 |
| 2,955,823 | A | * | 10/1960 | Chanko | 124/7 |
| 3,883,138 | A | * | 5/1975 | Chorey | 473/417 |
| 3,999,753 | A | * | 12/1976 | Desilets et al. | 473/418 |
| 4,176,838 | A | * | 12/1979 | Griffin | 473/417 |
| 4,227,691 | A | | 10/1980 | Lefebvre et al. | |
| 4,383,686 | A | | 5/1983 | Cardieri | |
| 4,445,685 | A | | 5/1984 | Cardieri | |
| 4,548,407 | A | * | 10/1985 | Sato | 124/7 |
| 4,575,080 | A | | 3/1986 | Miles | |
| 4,664,374 | A | | 5/1987 | Groves | |
| 4,709,924 | A | | 12/1987 | Wilson et al. | |
| 4,796,885 | A | | 1/1989 | Wright | |
| 4,819,937 | A | | 4/1989 | Gordon | |
| 4,854,587 | A | | 8/1989 | Groves | |
| 4,962,924 | A | | 10/1990 | James | |
| 4,989,866 | A | | 2/1991 | Dill | |
| 4,993,708 | A | | 2/1991 | Prossor et al. | |
| 5,004,234 | A | | 4/1991 | Hollis | |
| 5,087,039 | A | * | 2/1992 | Laseke | 473/417 |
| 5,156,402 | A | * | 10/1992 | Hart | 473/229 |
| 5,320,343 | A | | 6/1994 | McKinney | |
| 5,386,987 | A | | 2/1995 | Rodino, Jr. | |
| 5,388,823 | A | | 2/1995 | Prieto | |
| 5,439,225 | A | * | 8/1995 | Gvoich et al. | 473/223 |
| 5,472,186 | A | * | 12/1995 | Paulsen | 473/429 |
| D365,716 | S | * | 1/1996 | Rose, Sr. | D6/552 |
| 5,485,993 | A | * | 1/1996 | Lipsett | 473/448 |
| D373,806 | S | | 9/1996 | Bunnell | |
| 5,672,124 | A | | 9/1997 | Pecoraro et al. | |
| 5,848,945 | A | | 12/1998 | Miller et al. | |
| 5,897,444 | A | | 4/1999 | Hellyer | |
| D410,052 | S | | 5/1999 | Davis et al. | |
| 5,916,045 | A | | 6/1999 | Busch | |
| 5,928,092 | A | * | 7/1999 | Keeter et al. | 473/417 |
| 5,951,413 | A | | 9/1999 | Guerriero | |

(Continued)

*Primary Examiner*—Eugene Kim
*Assistant Examiner*—M. Chambers
(74) *Attorney, Agent, or Firm*—Polster, Lieder, Woodruff & Lucchesi

(57) ABSTRACT

A practice batting training apparatus is disclosed, which can accurately and consistently deliver balls to a desired location at a desired speed. The apparatus includes a base with a removable a post, and at least one feeder hingedly attached to the post for delivering various size balls to a desired location at a desired speed. The feeder can be adjusted to achieve different heights and speeds helping batters develop timing and hitting skills.

1 Claim, 5 Drawing Sheets

U.S. PATENT DOCUMENTS

| | | | | |
|---|---|---|---|---|
| D430,243 | S | 8/2000 | Alberti et al. | |
| 6,099,418 | A | 8/2000 | Owen | |
| D430,629 | S | 9/2000 | Alberti | |
| D433,722 | S | 11/2000 | Hsu et al. | |
| 6,238,307 | B1 | 5/2001 | Owen | |
| D451,566 | S | 12/2001 | DeChenne | |
| 6,358,163 | B1 | 3/2002 | Tanner | |
| D457,768 | S * | 5/2002 | Didehvar et al. | D6/559 |
| 6,398,671 | B1 | 6/2002 | Rios | |
| 6,413,175 | B1 | 7/2002 | Mooney, Jr. | |
| 6,416,429 | B1 | 7/2002 | Pecoraro et al. | |
| 6,679,794 | B1 * | 1/2004 | Vitello et al. | 473/433 |
| 6,682,445 | B1 | 1/2004 | Tanner | |
| 6,695,723 | B2 * | 2/2004 | Leal et al. | 473/417 |
| 2002/0010041 | A1 * | 1/2002 | Pearson | 473/479 |

* cited by examiner

BATTING TRAINING APPARATUS

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The invention relates, generally, to a practice batting training apparatus. More particularly, the invention relates to a baseball or softball training apparatus, which can accurately and consistently deliver balls to a desired location at a desired speed.

It is said that hitting is one of the most difficult skills to master in all of sports. To hit a ball well, a hitter must be able to coordinate the swing of the bat with the various positions of the ball at which it may cross home plate, from an inside pitch to an outside pitch, and from a high pitch to a low pitch, and various combinations in between. A hitter must also be able to coordinate the timing of the swing of the bat with the various speeds of the ball, from a fastball to a changeup. Generally, a good swing is one where the batter contacts the ball when it is at a position in front of home plate, thus allowing the batter's wrist to roll or snap as the ball is hit, thereby producing increased momentum of the bat for hitting power. Moreover, it is better to hit ground balls or line drives, rather than pop-ups or fly balls. To hit grounders or line drives, the batter must hit the upper half of the ball. To accomplish this, batters must be able to swing the bat along a proper plane or angle.

To develop these skills, trainers or coaches often use conventional batting tees. Batting tees are well known for use in improving the hitting of baseball and softball players. Typically, batting tees have a base shaped like home plate with a pipe or post extending upwardly from the center of the plate and terminating in a tee element. Usually, the tee element is a flexible piece of rubber upon which a baseball or softball to be hit may be supported. The height of the ball upon the tee is usually adjustable to simulate high and low pitches, as well as for use by different size players. However, such conventional batting tees lack the ability to develop timing skills because the ball remains stationary. In addition, conventional tees do not simulate inside and outside pitches for the hitter because the post is fixed in the center of the plate.

To develop timing and location skills, trainers and coaches often soft-toss to hitters. In other words, someone will toss a ball, usually underhanded, to a batter. This method can be especially helpful for younger players. However, it is difficult for a coach or trainer to accurately and consistently soft-toss a baseball or softball to the same location at the same speed. Similarly, automated pitching machines do not deliver balls consistently to the same location at the same speed. Automated pitching machines are also large, expensive, and not very portable. Therefore, there is a need for an inexpensive and portable batting training apparatus that can accurately and consistently deliver a baseball or softball to the same location at the same speed.

SUMMARY OF THE INVENTION

Briefly stated, in accordance with one embodiment of the invention, a batting training apparatus is provided, which includes a base, a post removeably attached to the base, and at least one feeder attached to the post for delivering various size balls to a desired location at a desired speed. Preferably, the feeder is pivotally attached to the post, or to a telescoping member that is adjustably mounted to the post. Preferably the post is removably mounted to the base.

In accordance with another embodiment of the invention, a batting training apparatus is provided, which includes a base, a post removeably attached to the base, a telescoping member coupled with the post which extends and retracts, a tee element coupled with the telescoping member for supporting various size balls, and at least one feeder hingedly attached to the telescoping member for delivering various size balls to a desired location at a desired speed.

In accordance with another embodiment of the invention, a batting training apparatus is provided, which includes a ring that secures to a standard batting tee, a shank attached to the ring, the shank comprising two segments connected by a pivoting joint, and at least two arms attached to the shank spaced to accommodate various size balls for delivering the balls to a desired location at a desired speed.

In accordance with another embodiment of the invention, a batting training apparatus is provided, which includes a means for attaching to a standard batting tee, and a means for delivering various size balls to a desired location at a desired speed.

The foregoing and other features, and advantages of the invention as well as embodiments thereof will become more apparent from the reading of the following description in connection with the accompanying drawings.

DESCRIPTION OF THE DRAWINGS

In the accompanying drawings which form part of the specification:

FIG. 6 is a perspective view of a second embodiment of the invention.

Corresponding reference numerals indicate corresponding parts throughout the several figures of the drawings.

DETAILED DESCRIPTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
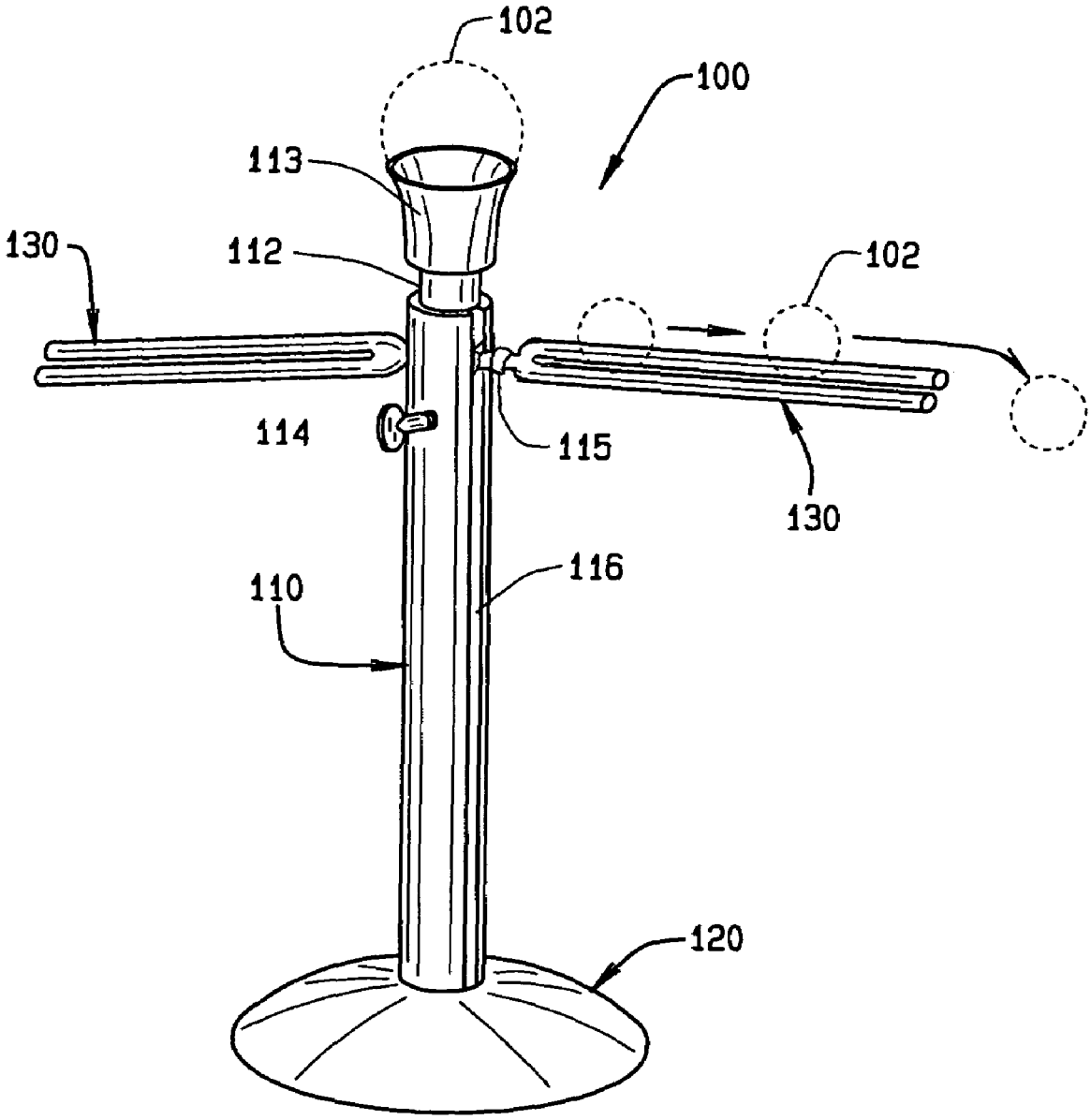
FIG. 1 is a perspective view of a first embodiment of the invention.
Figure 2:
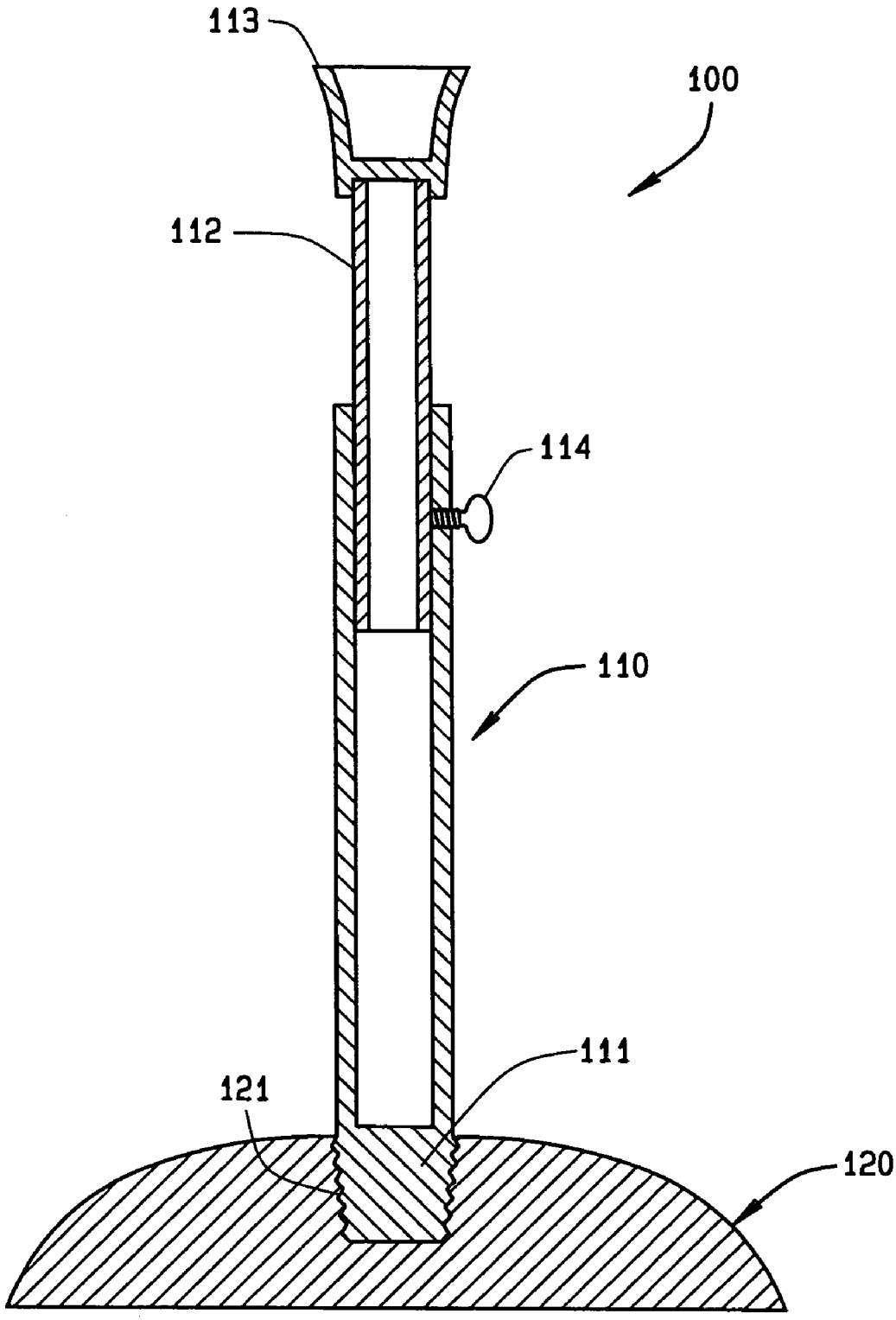
FIG. 2 is a sectional view of the first embodiment of the invention.

The present invention can be embodied in the apparatus 100 shown in FIGS. 1 and 2 comprising a post 110, a telescoping member 112, a base 120, and feeders 130. The post 110 is a cylindrical tube with a threaded end 111 for coupling with the base 120 and vertical dovetail slots 116 for coupling with the feeders 130. Opposite the threaded end 111 is a bore 115 for receiving the telescoping member 112. The telescoping member 112 comprises a cylindrical tube with an outer diameter that is smaller than the inner diameter of the bore 115 and a tee element 113 attached to a top end of the cylindrical tube. The telescoping member 112 inserts into the bore 115 of the post 110 so that the telescoping member 112 extends and retracts for adjusting the height of the tee element 113 to a desired height. The telescoping member 112 is secured with a locking pin 114, such as a wingnut or other appropriate means. The tee element 113 is a flexible tapered cup, which can support various size balls, such as a baseball or softball, for use as a standard batting tee. For durability, the telescoping member 112 and tee element 113 should be made from a material flexible enough so as to absorb the forces generated by a batter hitting the ball.

The base 120 is a convex disc with a threaded bore 121 for coupling with the post 110. To provide adequate stability and prevent the apparatus 100 from tipping over during use, the base 120 should be weighted appropriately. Those skilled in the art will recognize that the base can be any appropriate shape, size, or weight, such as a flat plate or the shape of home plate, which provides adequate stability to the apparatus 100.

Figure 3:
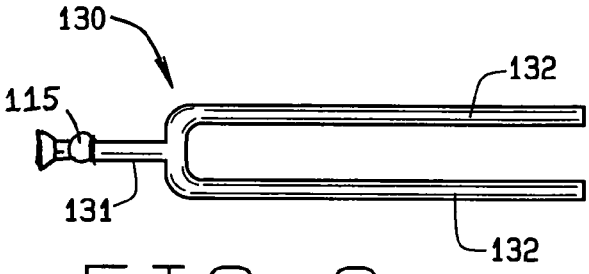
FIG. 3 is an overhead view of a first embodiment of a feeder.

In FIG. 1, the apparatus 100 includes two feeders 130, one on a left side and one on a right side to accommodate left-handed and right-handed hitters. As shown in FIG. 3, each feeder 130 comprises a shank 131 with two arms 132 attached for accurately delivering balls 101 to a batter. The shank 131 is separated into two segments connected by the pivoting joint 133, such as a ball and socket joint, which allows the arms 132 of the feeder 130 to be positioned at various angles. In this embodiment, the ball and socket pivoting joint 133 is a friction fit so that the pivoting joint 133 is stiff enough to maintain the arms 132 of the feeder 130 in any desired position during use, but loose enough to allow manual adjustment of the arms 132 by hand.

Referring to FIG. 3, the shank 131 terminates in a unitary dovetail lug 134 shaped to engage within the dovetail post slots 116. In the embodiment of FIGS. 1–6, lug 134 has a truncated pyramid shape. The lug 134 should be sized for a friction fit with the dovetail slots 116 so that the lugs 134 are loose enough within slot 116 to slide up and down by hand, but tight enough to maintain the lug 134 and feeder 130 in any desired position during use. In this way, the heights of the feeders 130 are adjustable by sliding up and down within the slots 116. To install a feeder 130, the lug 134 is aligned with the slot 116 in the top thereof, then slid downwardly by hand to the desired position. The feeders 130 can be removed from the post 110 by hand by sliding the lug 134 through the slot 116 all the way up the post and out of the slot 116.

The arms 132 of the feeders 130 are spaced at a distance that allows the feeder 130 to accommodate multiple sizes of balls, including a baseball, softball, or soccer ball. In this embodiment, the both arms 132 are spaced at 2½" which accommodates both a baseball and a softball. Those skilled in the art will recognize that, the arms 132 of each feeder 130 can be spaced differently to accommodate multiple sizes of balls. For example, the 132 arms of the feeder 130 on the left side can be spaced to accommodate a baseball, while the 132 arms of the feeder 130 on the right side can be spaced to accommodate a softball. To deliver balls at different speeds, feeders 130 of different lengths can be attached, such as, 12", 18", and 24" long. Those skilled in the art will recognize that, each feeder 130 can be of a different length to achieve different speeds. For example, the feeder 130 on the left side can be 12" in length, while the feeder 130 on the right can be 18" in length. Therefore, by utilizing feeders 130 with different lengths, arm spacing, heights, and angles, the feeder 130 can accurately deliver balls to a batter at an infinite number of positions and speeds.

In operation, the apparatus 100 can be used either as a training apparatus that delivers balls to a desired location and speed or as a standard batting tee. As a training apparatus, the trainer adjusts the feeders 130 to deliver a ball 102 to a desired location at a desired speed, by pointing the feeders 130 directly at the desired location whether it is inside, outside, high or low. To adjust the height of the location, the lugs 134 of the feeder 130 are slid up and down within the slots 116, as heretofore discussed. To adjust the angle of the arms 132 of the feeder 130, the trainer manually tilts the arms 132 at the pivoting joint 133. To increase the speed of the ball, the feeder 130 is adjusted downward to a steeper angle. Oppositely, to decrease the speed of the ball 102, the feeder 130 is adjusted upward to a less steep angle. In addition, the speed of the ball 102 can be adjusted be varying the length of the feeder 130. Longer feeders 130 will provide a faster speed, while shorter feeders 130 will provide a slower speed. Once the feeder is adjusted for the desired location and speed, the trainer places the ball 102 on the feeder 130 end nearest the shank 131 and releases. Consequently, the ball 102 rolls down the arms 132 of the feeder 130 and is delivered to the desired location for the batter to hit at a desired speed. Without any further adjustment, the trainer can repeatedly release balls 102 on the feeder to consistently deliver balls 102 to the batter at the same location and at the same speed.

Thus, a trainer can use the apparatus 100 to improve a batters timing and coordination. In addition, the apparatus can improve the batters swing plane by discouraging an upward swing. Due to the location of the feeder 130, an upward swing will cause the bat to strike the feeder 130, thus, discouraging the batter from an upward swing and encouraging a more desirable level swing. With a feeder 130 on both the left and right side of the post 110, left-handed and right-handed hitters can use the apparatus 100 separately or simultaneously.

When using the apparatus as a standard batting tee, the telescoping element 112 is adjusted to an appropriate height for the batter and secured with the locking pin 114. A ball 102 is placed on the tee element 113 and the batter hits the ball of the tee element 113.

When not in use, the apparatus 100 has the ability to be folded up and disassembled for storage. The feeders 130 can be either tilted downward at the pivoting joint 134 until the arms 132 of the feeder 130 are parallel with the post 110. As mentioned above, the feeders 130 can be disconnected from the post 110 altogether by sliding the lug 134 out of the slots 116. The base can be disconnected from the post 110 by unscrewing the threaded end 111 from the base 120. As a result, the apparatus 100 takes up very little space and can be stored or transported very easily.

Figure 4:
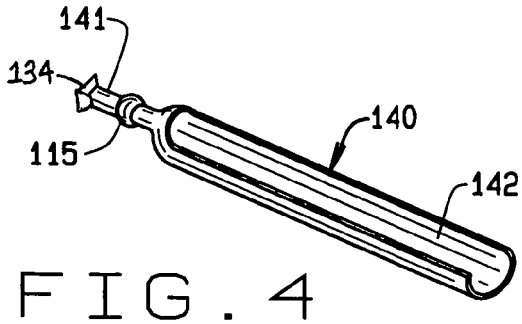
FIG. 4 is a perspective view of a second embodiment of the feeder.
Figure 5:
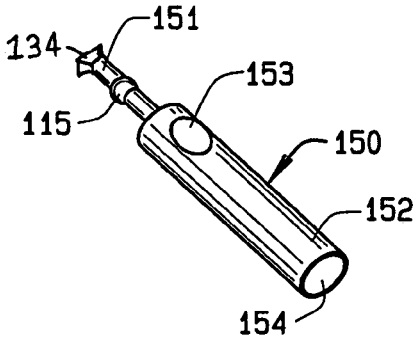
FIG. 5 is a perspective view of a third embodiment of the feeder.
Figure 6:
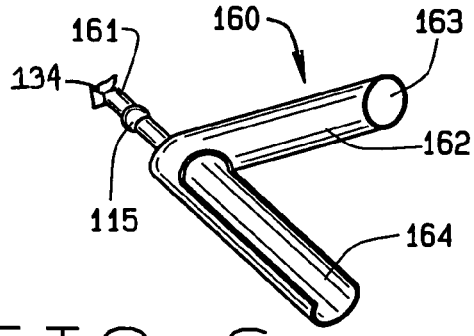
FIG. 6 is a perspective view of a fourth embodiment of the feeder.

Those skilled in the art will recognize that changes can be made in the above constructions without departing from the scope of the invention. For example, any number and length of feeder 130 can be used in the present invention. FIGS. 4–6 illustrate alternate embodiments of the feeder 130. FIG. 4 shows a feeder 140 with the shank 141 separated into two segments connected by the pivoting joint 133. Instead of two arms 132, the feeder 140 includes a chute 142.

FIG. 5 shows a feeder 150 that also has a shank 151 separated into two segments connected by the pivoting joint 133. However, a tube 152 is connected to the shank 151 defining a properly sized hole 153 sized to receive a ball for input and an output hole 154 for delivering the ball 102 to the batter.

FIG. 6 illustrates a self-serve feeder 160 which can be used unassisted by a batter. The feeder 160 is v-shaped with a shank 161 extending from the base of the v. A joint 133 is positioned on shank 161, as previously discussed. The feeder 160 includes a top portion 162 that is a cylindrical tube defining a ball input hole 163 and a bottom portion 164 that is a cylindrical chute. In operation, the batter places a ball 102 into the input hole 163 and the top portion 162 delivers the ball 102 to the bottom portion 164, which delivers the ball 102 to the desired location at the desired speed.

Figure 7:
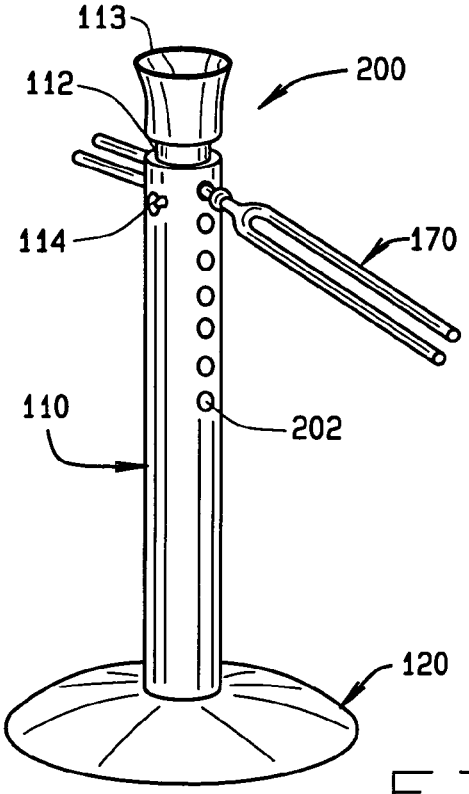
FIG. 7 is a perspective view is a fifth embodiment of the feeder.
Figure 8:
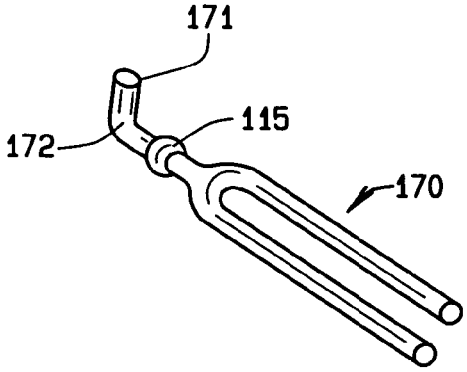
FIG. 8 is a perspective view of a third embodiment of the invention.

The present invention can also be embodied in the apparatus 200 shown in FIG. 7. Many of the elements in apparatus 200 are similar to the elements in apparatus 100. To aid in understanding, similar parts will use the same number as in apparatus 100. In place of slots 116, apparatus 200 includes a plurality of holes 202 vertically aligned along the post 110. As shown in FIG. 8, the shank 171 of the feeder 170 includes an elbow 172 for coupling with the holes 202. The elbow 172 inserts into a desired hole 202 and is secured by resting against the inner diameter of the post 110. The weight of the feeder 130 provides enough friction between the elbow and the inner diameter of the post 110 to adequately secure the elbow 172 and feeder 130. In operation, the height of the feeder 170 is adjusted by inserting the elbow 172 in the appropriate hole 202. In all other aspects, apparatus 200 operates similar to apparatus 100 and will not be described again here.

Figure 9:
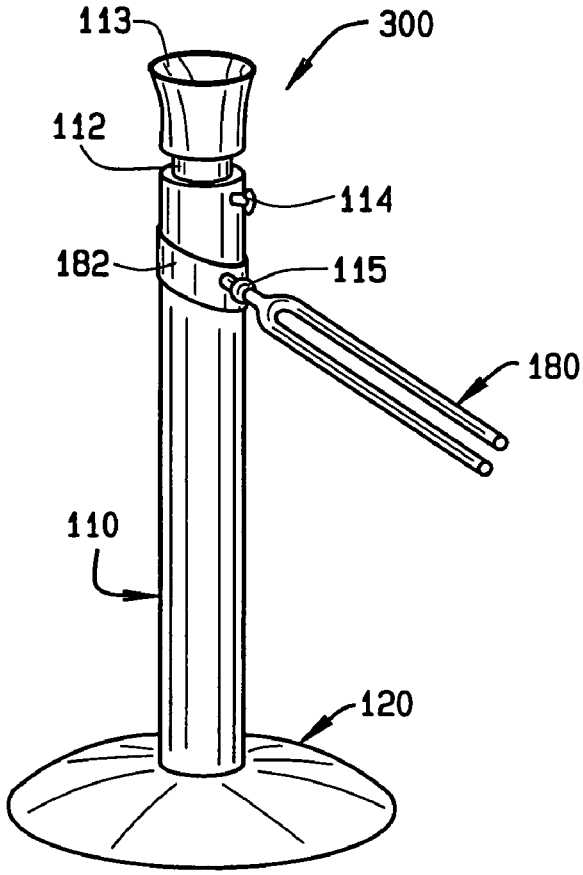
FIG. 9 is an overhead view of a sixth embodiment of the feeder.
Figure 10:
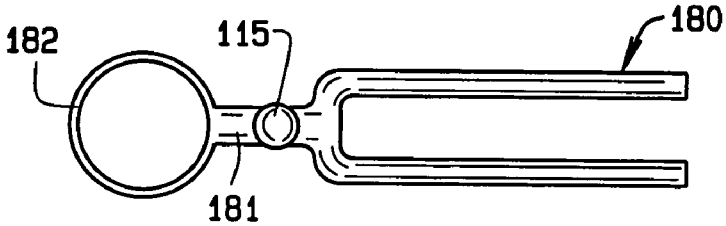
FIG. 10 is a side view of the sixth embodiment of the feeder.
Figure 11:
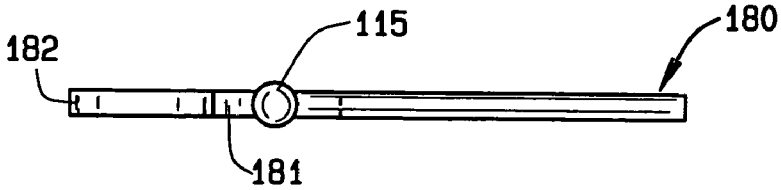
FIG. 11 is a fourth embodiment of the invention.

The present invention can also be embodied in the apparatus 300 shown in FIG. 9. Many of the elements in apparatus 300 are similar to the elements in apparatus 100. To aid in understanding, similar parts will use the same number as in apparatus 100. Apparatus 300 does not contain any slots 116 for vertical adjustment of a feeder 180. Instead, the feeder 180 shown in FIGS. 10 and 11 provides for vertical adjustment. The shank 181 of feeder 180 terminates in a ring 182. The inner diameter of the ring 182 should be larger than the outer diameter of the post 110 so that there is adequate clearance, such as ¼". In operation, the ring 182 slides over the post 110 and secures to the post by resting against the post 110 at an angle. The weight of the feeder 180 provides enough friction between the ring 182 and the post 110 to adequately secure the feeder 180. In all other aspects, apparatus 200 operates similar to apparatus 100 and will not be described again here. It is important to note that the feeder 180 can be also be used with any standard batting tee, and thus can easily be sold separately from the rest of the apparatus.

Figure 12:
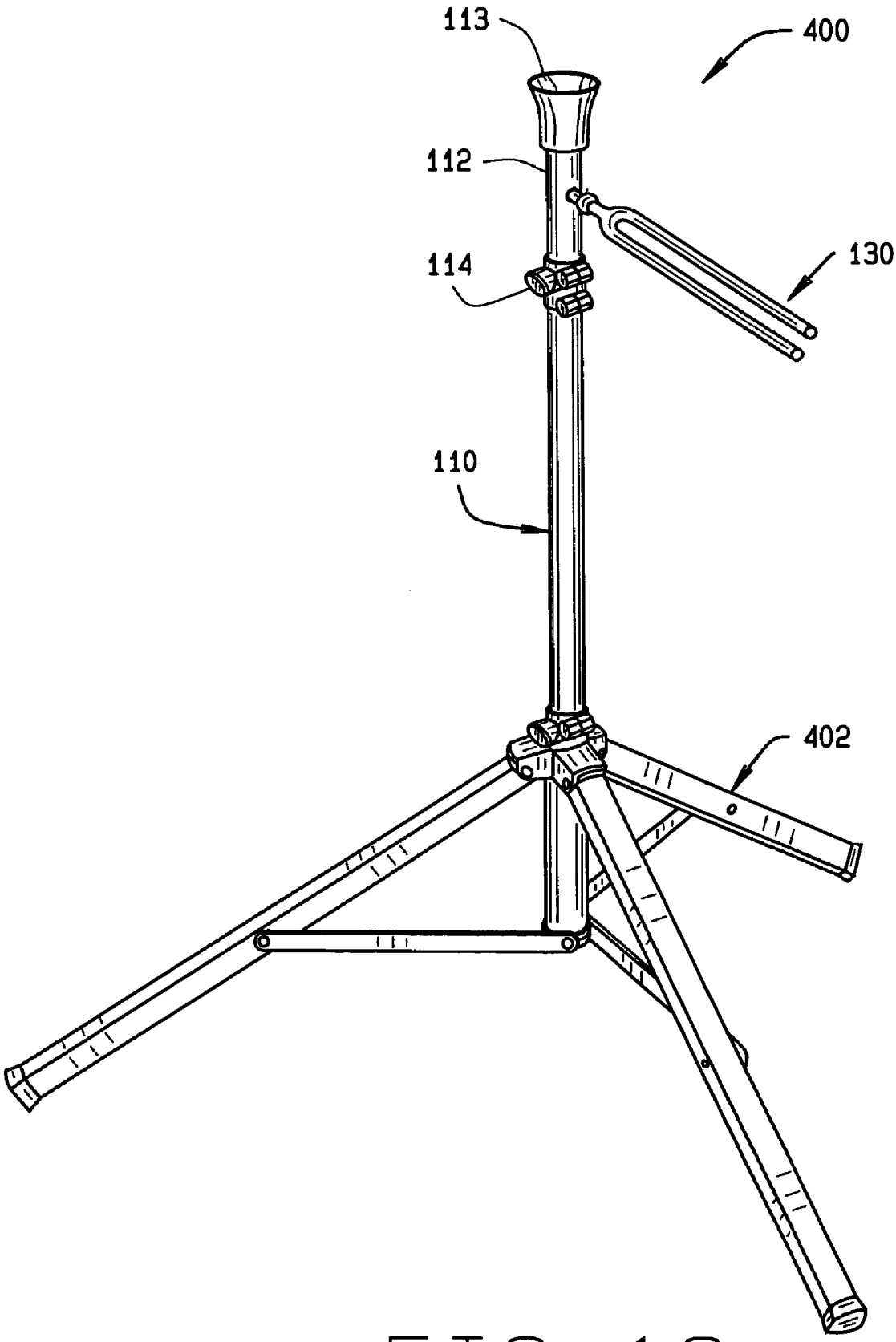
FIG. 12 is a fifth embodiment of the invention.

The present invention can also be embodied in the apparatus 400 shown in FIG. 12. Many of the elements in apparatus 400 are similar to the elements in apparatus 100. To aid in understanding, similar parts will use the same number as in apparatus 100. In place of the circular base 120, apparatus 400 includes a tripod 402. The tripod 402 allows the user to quickly fold up the apparatus 400 for storage. The shank 131 of the feeder 130 is fixedly attached to the telescoping member 112 by an appropriate means, such as welding, rather than the post 110. In this way, the height of the feeder 130 is adjusted by adjusting the height of the telescoping member 112. In all other aspects, apparatus 200 operates similar to apparatus 100 and will not be described again here. Those skilled in the art will recognize that the feeder 130 may also be removably attached to the telescoping member by an appropriate means, such as dovetail means of corresponding holes and elbows as previously described above.

In another embodiment (not shown), of the feeder 130 has telescoping arms to allow the length of the feeder 130 to be varied, thus, eliminating the need for multiple lengths of feeders 130. In yet another embodiment (not shown), the feeders 130 are removeably attached with appropriate means, such as dovetail slots or elbows, to the telescoping member 112, instead of to the post 110, thus, allowing vertical adjustment of the feeders 130 through the adjustment of member 112. Therefore, it is intended that all matter contained in the above description or shown in the accompanying drawings shall be interpreted as illustrative and not in a limiting sense.

The invention claimed is:

1. A batting training apparatus comprising:

a base;

a post removeably attached to the base, wherein the post and feeder are shaped so that the height of the feeder can be adjusted relative to the post so that the feeder can be moved and supported at different positions on the post;

at least one feeder member pivotally attached to the post, the feeder being sized to movably support various size balls for delivery to a desired location at a desired speed;

a telescopic member shaped to be movably mounted to the post;

a tee element associated with the member, the tee element being shaped for supporting various size balls;

wherein the post further comprises at least one slot, and the feeder has a portion shaped to fit within the slot to allow vertical adjustment of the feeder;

wherein the feeder further comprises a shank and at least two arms attached to the shank spaced to accommodate various size balls for delivering the balls to a desired location at a desired speed; and wherein the shank comprises two segments connected by a pivoting joint.

* * * * *